US007779514B2

(12) United States Patent
Van Doorn

(10) Patent No.: US 7,779,514 B2
(45) Date of Patent: Aug. 24, 2010

(54) METHOD AND APPARATUS FOR SEPARATING FOREIGN MATTER FROM FIBROUS MATERIAL

(75) Inventor: Donald William Van Doorn, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 74 days.

(21) Appl. No.: 12/168,497

(22) Filed: Jul. 7, 2008

(65) Prior Publication Data

US 2009/0172918 A1 Jul. 9, 2009

Related U.S. Application Data

(60) Provisional application No. 60/950,222, filed on Jul. 17, 2007.

(51) Int. Cl.
*D01B 1/00* (2006.01)

(52) U.S. Cl. ..... 19/205; 19/200

(58) Field of Classification Search ..... 19/60, 19/64, 64.5, 200, 205
See application file for complete search history.

(56) References Cited

U.S. PATENT DOCUMENTS

| | | | | | |
|---|---|---|---|---|---|
| 5,173,994 | A * | 12/1992 | Gillum et al. | ..... | 19/55 R |
| 5,295,283 | A * | 3/1994 | Gillum et al. | ..... | 19/55 R |
| 5,414,900 | A * | 5/1995 | Gillum et al. | ..... | 19/55 R |
| 5,909,786 | A * | 6/1999 | Anthony | ..... | 19/41 |
| 6,088,881 | A | 7/2000 | Van Doorn | | |
| 6,449,804 | B1 * | 9/2002 | Van Doorn | ..... | 19/48 R |
| 6,615,454 | B1 * | 9/2003 | Anthony | ..... | 19/41 |
| 6,865,781 | B2 * | 3/2005 | Hosel | ..... | 19/200 |
| 2007/0221248 | A1 * | 9/2007 | Boatman | ..... | 134/6 |

* cited by examiner

*Primary Examiner*—Shaun R Hurley
(74) *Attorney, Agent, or Firm*—Smith, Gambrell & Russell

(57) ABSTRACT

An apparatus for cleaning foreign matter from separated tufts of fiber uses a revolving open reel type structure mounted within a porous housing to separate a conveying air stream from tufts of fiber conveyed thereby and deliver the tufts to a toothed cleaning cylinder which passes beneath a plurality of cleaning bars. The open reel utilizes brush like outer surfaces to sweep tufts of fiber from the housing back into the air stream adjacent the cleaning cylinder.

15 Claims, 1 Drawing Sheet

METHOD AND APPARATUS FOR SEPARATING FOREIGN MATTER FROM FIBROUS MATERIAL

This application claims priority to U.S. provisional application No. 60/950,222, filed Jul. 17, 2007, which is incorporated herein by reference.

BACKGROUND OF THE INVENTION

This invention relates to cotton fiber processing and more particularly to an apparatus and method of separating foreign matter from fibrous cotton that has been ginned from the seed.

Prior methods and apparatus include those such as illustrated in U.S. Pat. No. 6,088,881, incorporated herein by reference, wherein a revolving perforated drum is used to allow air flow through the drum such that a cleaning cylinder may remove cotton fiber from the perforated drum and carry it past a plurality of cleaning grid bars, thereby separating the air flow and removing foreign matter from the fibers, before the fiber is doffed from the cleaning cylinder for subsequent air flow to downstream processing.

However, the perforated revolving cylinder of the '881 apparatus, revolving at velocities to prevent agglomeration of the tufts in the air stream, develops centrifugal forces that cause the fine trash and very short fibers that penetrate the perforations to accumulate on the interior surfaces of the perforated cylinder. These accumulations require the use of compressed air blasts to cause them to move axially out the open ends of the cylinder. While the compressed air blasts provide a solution to this problem of accumulations, the maintenance and cost of the compressed air system detracts from the otherwise excellent performance of the apparatus per the '881 patent.

BRIEF DESCRIPTION OF THE DRAWINGS

An apparatus embodying features of the invention is depicted in the accompanying drawing wherein.

BRIEF SUMMARY OF THE INVENTION

Figure 1:
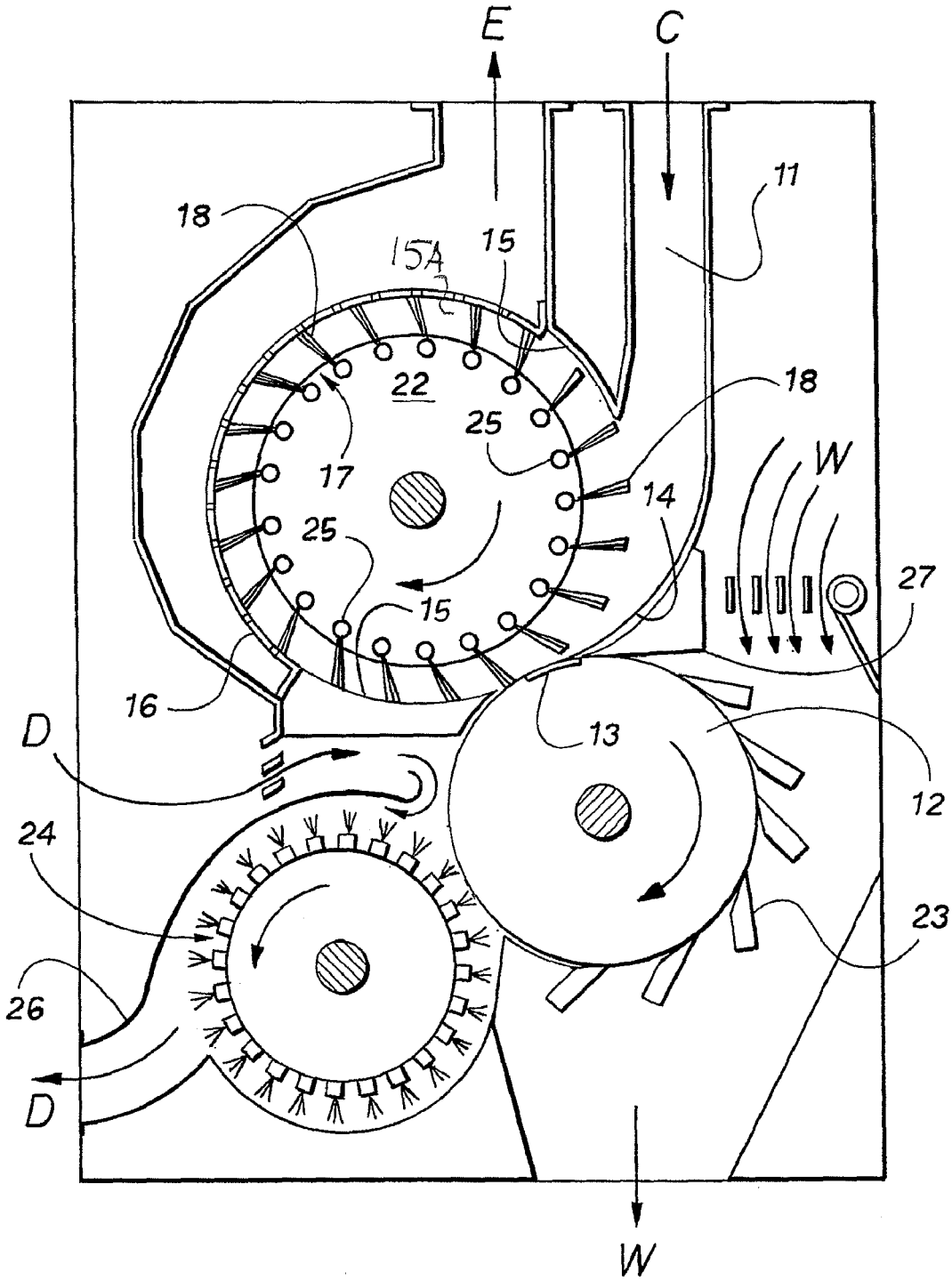
FIG. 1 is a sectional side elevational view of an embodiment of an apparatus of the present invention.

It is an object of the present invention to provide an improved method and apparatus for separating foreign matter from tufts of fibrous cotton. A further object of the invention is to eliminate the need for a compressed air system for cleaning a perforated separator cylinder, while maintaining the other features of the '881 patent by the use of a novel revolving separator in combination with a stationary arcuate perforated section.

DETAILED DESCRIPTION OF THE INVENTION

An improved apparatus and method according to the present invention is illustrated in reference to FIG. 1, wherein fiber tufts commingled with foreign matter are pneumatically carried by a conveying air stream C into the apparatus via an air duct 11 as is well known in the art. Air duct 11 terminates adjacent an outer surface of a revolving cleaning cylinder 12 and a stationary separator housing. Duct 11 has an arcuate terminal wall portion 14 disposed adjacent to cleaning cylinder 12 to deliver the fiber tufts directly to a plurality of teeth 13 carried by the cleaning cylinder 12 and capable of holding the fiber tufts on said teeth 13. The cylindrical housing comprises an arcuate non-porous surface 15, a semi-cylindrical perforated surface or section 16, and a non porous segment 15*a* spaced from terminal portion 14 of duct 11 at the end of a minor chord drawn through revolving cylinder 12, such that the cylindrical housing is open to duct 11 opposite terminal wall portion 14. Perforated surface 16 is a stationary separator that is porous to air flow there through but impervious to desirable fiber flow there through. Rotating within the cylindrical housing is an revolving air separator 17 which is pervious to both fiber and foreign matter. As may be seen in FIG. 1, terminal wall portion 14 of duct 11 converges toward revolving air separator 17 near cleaning cylinder 12 such that fiber tufts carried by the conveying air stream are directed substantially on to the teeth 13 of cleaning cylinder 12 while the direction of the conveying air flow is gradually changed toward the cylindrical housing comprising perforated surface 16.

Again as may be seen in FIG. 1, revolving separator 17 includes a plurality of circumferentially spaced outer surfaces 18 such that the spaces between spaced outer surfaces 18 are sufficient to allow the conveying air to pass between the spaced surfaces 18 as air duct 11 converges toward the spaced surfaces 18 without abruptly increasing the conveying air velocity. Outer surfaces 18 pass proximal to the revolving cleaning cylinder 12 and semi-cylindrical stationary surface 16

In one embodiment outer surfaces 18 are defined by circumferentially spaced apart flexible belt-like strips running generally parallel to the axis of rotation of air separator 17 and generally radial to the axis of rotation. The strips are flexible radially and may be made of soft material to resist damage to the cleaning cylinder 12 or semi-cylindrical stationary surface 16. In another embodiment, spaced outer surfaces 18 are defined by circumferentially spaced apart brush strips running generally parallel to the axis of rotation with the bristles facing outward generally radial to the axis of rotation of the air separator 17. Suitable hub plates 22 hold the hubs 25 of the strips 18 in place forming an open reel. In either embodiment, the strips are preferably set at a deflection angle of the strips approximately 15 degrees backward from radial to the axis of rotation of the rotating separator 17 relative to its direction of rotation.

The conveying air stream C thus passes through the air separator 17 and is exhausted from the cylindrical housing via perforated surface 16 to become exhaust air stream E. It is worthwhile to note that as outer surfaces 18 rotate across perforated surface 16 the surfaces 18 substantially sweep away any accumulations of matter on the stationary separator surface 16 and return any desirable fiber back to the conveying air stream C, proximal to terminal portion 14 of duct 11. To effectively accomplish this, revolving outer surfaces 18 move at velocities that develop centrifugal forces sufficient to cause heavier than air matter revolving with the outer surface 18 to move substantially radially outwardly. Further the hubs or inner surface 25 of the strips 18 are configured to resist accumulation of matter heavier than air thereon, such that the rotation of the hub 25 and surfaces 18 moves such matter outwardly where it may be directed towards cleaning cylinder 12. The rotation of revolving outer surfaces 18 is such that the commingled fiber and foreign matter are exposed to the teeth 13 of the cleaning cylinder 12 while the revolving outer surfaces 18 are rotating toward stationary semi cylindrical surface 16.

As will be understood from the prior art, the rotation of cleaning cylinder 12 carries the tufts past a stripping bar 27 and plurality of cleaning grid bars 23 disposed to separate a major portion of foreign matter from the cleaning cylinder 12, which foreign matter may be disposed via a trash conveyor system for subsequent collection and baling. In the embodiment depicted, foreign matter is disposed via a waste airflow W.

As will also appreciated, a rotating doffing cylinder or brush 24 removes the cleaned tufts from the teeth 13 of cleaning cylinder 12 and delivers the cleaned fibers to duct 26. In the embodiment depicted, the cleaned tufts may be entrained in a doffing air flow D which passes adjacent doffing brush 24 and into duct 26.

The apparatus may be used to process cotton fiber according to the following description. Spaced apart individual tufts of fiber are conveyed in a high speed conveying air stream C to minimize agglomeration of the tufts, first exposing the air stream to revolving separator 17 which is porous to radially inward and outward air flow and revolving at speeds developing centrifugal forces that cause the fiber tufts and foreign matter rotationally moving with the porous revolving separator 17 to resist radially inward movement such that the fiber tufts and foreign are substantially removed from the conveying air C as it passes through the porous revolving air separator 17. Thus, the preponderance of the fiber tufts and foreign matter are delivered directly to revolving toothed cleaning cylinder 12 in close proximity to the revolving separator 17.

A stationary generally cylindrical surface is located downstream of the revolving toothed cylinder 12 relative to the rotation of and proximal to the porous revolving air separator 17. The stationary arcuate surface includes a porous section 16 being porous to air flow there through, but impervious to desirable fiber flow, and preferably contains one or more non-porous sections 15. The rotational movement of the outer surfaces 18 carried by revolving porous air separator 17 proximate stationary arcuate surface sweeps any accumulations of desirable fiber from the upstream side of arcuate stationary surface 15, 16 delivering the fibers back into the conveying air stream C. The periphery of the revolving separator 17 should be porous to radially inward and outward air flow and have means on the radially inward surfaces to prevent the accumulation of matter heavier than air.

Revolving toothed cylinder 12 holds the tufts while revolving past stripping bar 27 and cleaning bars 23 that strip foreign matter from the fiber tufts. A doffing brush or roller 24 revolving proximate and counter to toothed cleaning cylinder 12 removes the cleaned fibers from teeth 13 and delivers the cleaned fiber tufts from the process.

While the forgoing specification describes only a few embodiments of the present invention, the invention is not so limited and is intended to encompass the full scope of the claims appended hereto.

I claim:

1. In a fiber cleaning apparatus in which fiber tufts are pneumatically conveyed into the apparatus in an air stream commingled with foreign matter, the improvement comprising:

a) a revolving cleaning cylinder having teeth on a periphery thereof capable of engaging fiber tufts;

b) an air duct directing the air stream containing the fiber tufts comingled with the foreign matter, said air duct terminating at an outlet adjacent the periphery of said revolving cleaning cylinder such that a primary portion of the fiber tufts are delivered directly to said teeth;

c) a revolving reel comprising a plurality of outer surfaces circumferentially spaced to allow the air stream to pass through said reel without abruptly increasing the air stream velocity mounted for rotation about an axis parallel said cleaning cylinder and positioned adjacent said outlet and said cleaning cylinder, said reel partially circumscribed by a screen pervious to air flow and impervious to said tufts such that air flow passing through said reel exits through said screen depositing said tufts thereon.

2. The fiber cleaning apparatus of claim 1, wherein said reel is driven for rotation such that the spaced outer surfaces direct fiber tufts and foreign matter toward the teeth of said cleaning cylinder.

3. The fiber cleaning apparatus of claim 2, wherein the outer surfaces are disposed to sweep tufts and foreign matter from the stationary screen to the air stream upstream of said separating cylinder.

4. The fiber cleaning apparatus of claim 2, wherein the outer surfaces comprise a flexible belt-like strip with a length running generally parallel to the axis of rotation of the revolving reel and a width extending generally radially from the axis of rotation.

5. The fiber cleaning apparatus of claim 2, wherein the outer surfaces comprise a brush strip with a length running generally parallel to the axis of rotation of the revolving separator and a width extending generally radially from the axis of rotation.

6. The fiber cleaning apparatus of claim 2, wherein the spaced outer surfaces face approximately 15 degrees backward from radial to the axis of rotation of the revolving reel relative to the direction of rotation.

7. The fiber cleaning apparatus of claim 2, wherein the spaced outer surfaces are radially flexible.

8. The fiber cleaning apparatus of claim 2, wherein the outer surfaces have a radially inner portion adapted to resist accumulation of said tufts and foreign matter.

9. The fiber cleaning apparatus of claim 1, wherein said revolving reel moves at velocities that develop centrifugal forces sufficient to cause the tufts and foreign matter revolving with said outer surfaces to move radially outwardly.

10. In a process for removing foreign matter from spaced apart individual tufts of fiber conveyed in an air stream to minimize agglomeration of the tufts, the process comprising:

a) directing said air stream through a revolving separator reel porous to radially inward and outward air flow, and revolving at speeds developing centrifugal forces that cause said fiber tufts and foreign matter rotationally moving with said revolving separator reel to resist radially inward movement such that the said tufts and foreign matter moving with said revolving separator reel are separated from the conveying air and directed to a revolving toothed cylinder in close proximity to said revolving separator reel; and b) directing said air stream through a stationary separator screen porous to air flow and impervious to flow of desirable fiber, said separator screen located proximal and downstream of said revolving separator reel, thereby separating desirable fiber from said air stream.

11. The process of claim 10 further comprising removing the desirable fiber from the stationary separator screen by rotating said revolving separator reel proximate to said stationary separator screen.

12. The process of claim 10, wherein the removing comprises sweeping an upstream surface of said stationary separator screen with circumferentially spaced outer surfaces disposed on said revolving separator reel.

13. The process of claim 12, further comprising returning the desirable fiber removed from the stationary separator screen to said air stream.

14. A fiber cleaning apparatus in which fiber tufts are pneumatically conveyed into the apparatus in an air stream commingled with foreign matter comprising:

a) a revolving cleaning cylinder having a plurality of teeth capable of holding the fiber tufts;

b) an air duct terminating at an outlet and directing a primary portion of the fiber tufts directly to said teeth revolving proximal said outlet;

c) a revolving separator reel, porous to both inward and outward flow of air and fiber tufts, located proximal the outlet of said air duct for directing a secondary portion of the fiber tufts and foreign matter to said teeth; and d) a stationary separator screen, porous to air flow but impervious to the flow of desired fiber tufts, positioned downstream from the revolving separator reel, for separating fiber tufts from the airstream.

15. The fiber cleaning apparatus of claim 14, wherein the revolving separator reel comprises circumferentially spaced outer surfaces for sweeping the desired fiber tufts and accumulated foreign matter from said stationary separator screen and returning the desired fiber tufts and foreign matter to the airstream.

* * * * *